US009260897B2

(12) United States Patent
Wolk

(10) Patent No.: US 9,260,897 B2
(45) Date of Patent: Feb. 16, 2016

(54) HIDDEN INTERLOCKING HINGE ASSEMBLY

(71) Applicant: L. T. Hampel Corp., Germantown, WI (US)

(72) Inventor: Edward G. Wolk, Allenton, WI (US)

(73) Assignee: L. T. Hampel Corp., Germantown, WI (US)

( * ) Notice: Subject to any disclaimer, the term of this patent is extended or adjusted under 35 U.S.C. 154(b) by 0 days.

(21) Appl. No.: 13/774,407

(22) Filed: Feb. 22, 2013

(65) Prior Publication Data

US 2013/0219796 A1 Aug. 29, 2013

Related U.S. Application Data

(60) Provisional application No. 61/603,007, filed on Feb. 24, 2012.

(51) Int. Cl.

| | |
|---|---|
| ***E04B 1/344*** | (2006.01) |
| ***E05D 7/04*** | (2006.01) |
| ***B21K 13/02*** | (2006.01) |
| ***E06B 3/88*** | (2006.01) |
| *E05D 7/00* | (2006.01) |
| *E06B 3/70* | (2006.01) |

(52) U.S. Cl.

CPC . *E05D 7/04* (2013.01); *B21K 13/02* (2013.01); *E06B 3/88* (2013.01); *E05D 7/009* (2013.01); *E05Y 2900/132* (2013.01); *E06B 2003/7046* (2013.01); *Y10T 29/24* (2015.01)

(58) Field of Classification Search

CPC ..... E05D 5/023; E05D 7/009; E06B 3/36; B21K 13/02

USPC ..... 49/381, 397, 400, 401; 16/225, 234; 4/446, 460, 476–478

See application file for complete search history.

(56) References Cited

U.S. PATENT DOCUMENTS

| | | | | |
|---|---|---|---|---|
| 2,775,478 | A * | 12/1956 | Stimetz et al. | 49/239 |
| 4,186,460 | A * | 2/1980 | Artman | 16/274 |
| 4,305,164 | A * | 12/1981 | Sargent et al. | 4/462 |
| 4,748,716 | A * | 6/1988 | Bentz et al. | 16/237 |
| 5,544,595 | A * | 8/1996 | Stephenson et al. | 109/74 |
| 6,070,297 | A * | 6/2000 | Borer | 16/266 |
| 6,257,154 | B1 * | 7/2001 | Kasper | 109/73 |
| 6,370,706 | B1 * | 4/2002 | Walraven | 4/321 |
| 6,691,370 | B2 * | 2/2004 | Tatara | 16/355 |
| 6,766,541 | B2 * | 7/2004 | Adams et al. | 4/449 |
| 7,213,374 | B2 * | 5/2007 | Harris et al. | 52/79.1 |
| 8,096,052 | B2 * | 1/2012 | Hampel | 29/897.2 |
| 2010/0212082 | A1 * | 8/2010 | Tyler et al. | 4/476 |
| 2010/0327478 | A1 * | 12/2010 | Hampel | 264/160 |

* cited by examiner

*Primary Examiner* — Katherine Mitchell
*Assistant Examiner* — Abe Massad
(74) *Attorney, Agent, or Firm* — Quarles & Brady LLP

(57) ABSTRACT

The hidden interlocking hinge assembly at least partially hides or conceals the hinging mechanism of a door pivotally attached to a jamb. The assembly incorporates interlocking knuckles on the door and the jamb, an overlapping flange feature, and a corresponding depression feature that allows the overlapping flange and the depression to move relative to the other without binding and while generally concealing the balance of the assembly.

11 Claims, 30 Drawing Sheets

HIDDEN INTERLOCKING HINGE ASSEMBLY

CROSS REFERENCES TO RELATED APPLICATIONS

This patent application claims priority to U.S. Provisional Application No. 61/603,007 filed on Feb. 24, 2012, which is hereby incorporated by reference as if fully set forth herein.

STATEMENT REGARDING FEDERALLY SPONSORED RESEARCH

Not applicable.

BACKGROUND OF THE INVENTION

The present invention relates to hinge assemblies, and more particularly to hidden interlocking hinge assemblies used to hinge a door to a corresponding jamb.

Doors of all shapes and sizes are pivotally coupled to matching jambs to allow the door to pivot. In one common application, the door is able to pivot between a closed position, at which the door is generally flush with the plane of the door jamb, and an opened position, at which the door is generally skewed relative to the plane of the door jamb. In many applications the door is pivotally coupled to the jamb with several separate hinge assemblies that are spaced along the hinged edge of the door and separately coupled to both the door and the jamb. The space required to install and operate these types of secondary or add-on hinge assemblies often results in a space between the hinged edge of the door and the hinged edge of the jamb. This space is undesirable in many applications, such as in public restroom stalls, storage sheds, etc. In addition, the arrangement of the hinge assembly results in the hinge assembly being exposed on at least one side of the door-jamb combination, which can be aesthetically unpleasing and/or present a catch point.

Certain applications provide additional challenges; for instance, molded plastic doors are used in a variety of settings, such as garbage dumpster lids, utility sheds, and portable toilets. These applications typically require a robust, low-cost hinge assembly that allows the door to repeatedly open/close and to perform its intended function (e.g., prevent water from entering the garbage dumpster, inhibit access into the utility shed, and provide privacy to a person using the portable toilet) in all types of environmental conditions (e.g., rain, snow, wind, extreme temperatures, etc.).

In light of at least the above, a need exists for a hinge assembly having an improved design concept that establishes a robust, aesthetically pleasing hinge assembly that simultaneously complements the ultimate functionality of the door.

SUMMARY OF THE INVENTION

The hidden interlocking hinge assembly concept at least partially hides or conceals the hinging mechanism of a door pivotally attached to a jamb. The concept incorporates interlocking knuckles on the door and the jamb, an overlapping flange feature, and a corresponding depression feature that allows the overlapping flange and the depression to move relative to the other without binding and while generally concealing the balance of the hinge assembly.

These and still other aspects will be apparent from the description that follows. In the detailed description, preferred example embodiments will be described with reference to the accompanying drawings. These embodiments do not represent the full scope of the concept; rather the concept may be employed in other embodiments. Reference should therefore be made to the claims herein for interpreting the breadth of the invention.

DETAILED DESCRIPTION OF AN EXAMPLE EMBODIMENT

The example hidden interlocking hinge assembly is described below and shown in FIGS. 1-32 in the context of a portable toilet; however, as one skilled in the art will appreciate, when given the benefit of this disclosure, the inventive concepts described can be incorporated with various other contraptions, such as garbage dumpsters, utility sheds, and many other hinged applications. Furthermore, throughout the description, terms such as front, back, side, top, bottom, up, down, upper, lower, inner, outer, above, below, and the like are used to describe the relative arrangement and/or operation of various components of the example embodiment; none of these relative terms are to be construed as limiting the construction or alternative arrangements that are within the scope of the claims.

The hidden interlocking hinge assembly concept at least partially hides or conceals the hinging mechanism of a door pivotally attached to a jamb. The concept incorporates interlocking knuckles, an overlapping flange feature, and a corresponding depression, recess, indent, or "gap" that allows relative movement between the overlapping flange feature and the depression feature without binding and while generally concealing the balance of the hinge assembly.

In the example embodiment, the closing of an opening consisting of a door attached to a jamb is described. The closing of any opening can be accomplished with multiple variations of doors with hinges. The hidden interlocking hinge assembly concept allows for the closing of an opening without the need for secondary or add-on hinges attached to a door and a jamb. Incorporating hidden integrated interlocking knuckles connected together, in the example embodiment, by a hinge pin passing through the knuckles on the door and the jamb, allows for the closing of the opening without viewing the integrated interlocking knuckles from the outside viewing position of the opening. When the flange feature is designed into the door (as in the example embodiment), to be able to achieve the opening of the door with the integrated interlocking knuckles, a recess or "gap" can be designed into the frame/jamb to allow the overlapping flange feature of the door to rotate into the depression without binding on the jamb, which would inhibit the door from opening fully outward. The concept provides for a configuration that hides the internal hinging mechanism attaching a door to a jamb, and incorporates: interlocking knuckles on the door and the jamb, a hinge pin (used in the example embodiment), a flange feature (illustrated as extending from the door in the example embodiment), and a corresponding depression (illustrated as being formed in the jamb in the example embodiment) to allow the overlapping flange feature to pivot without binding on the fixed component.

Figure 1:
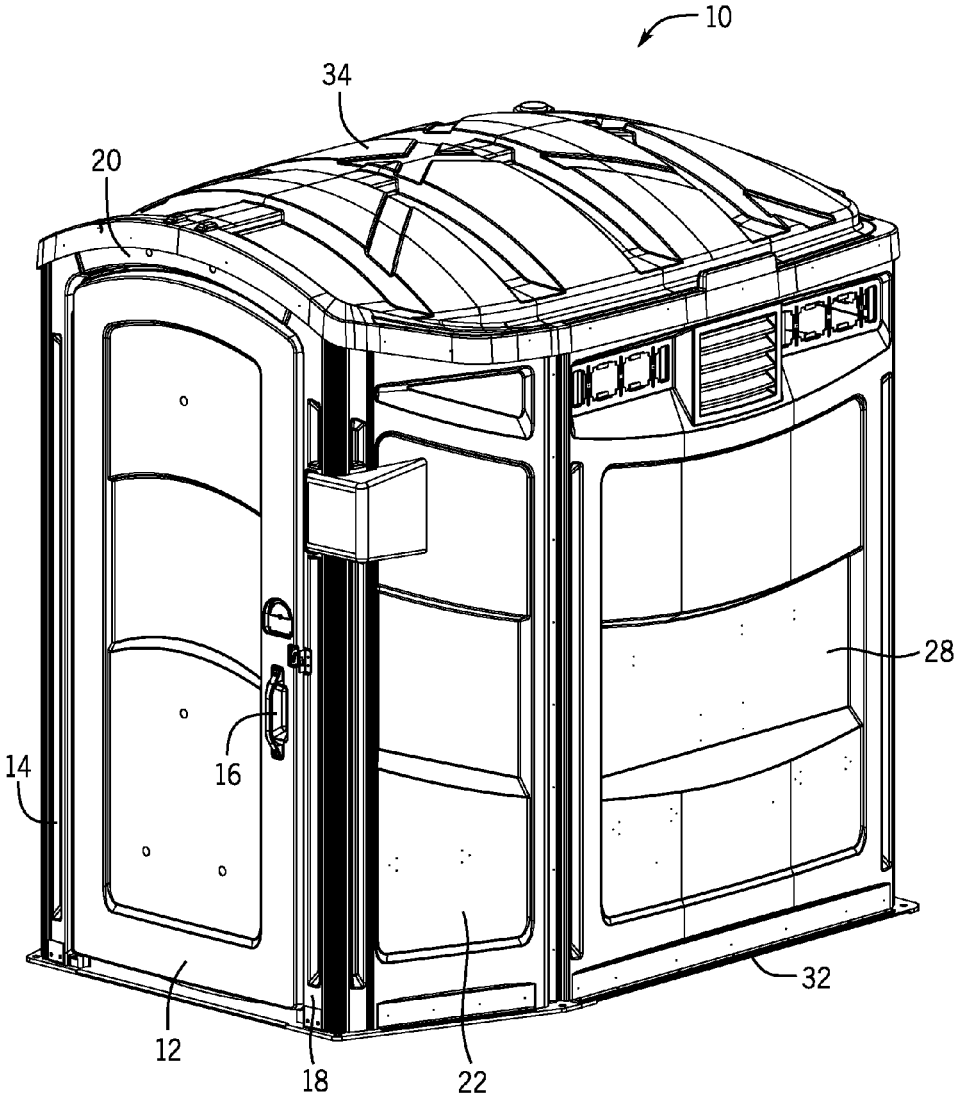
FIG. 1 is a front isometric view of an example portable toilet incorporating an example hidden interlocking hinge assembly.
Figure 2:
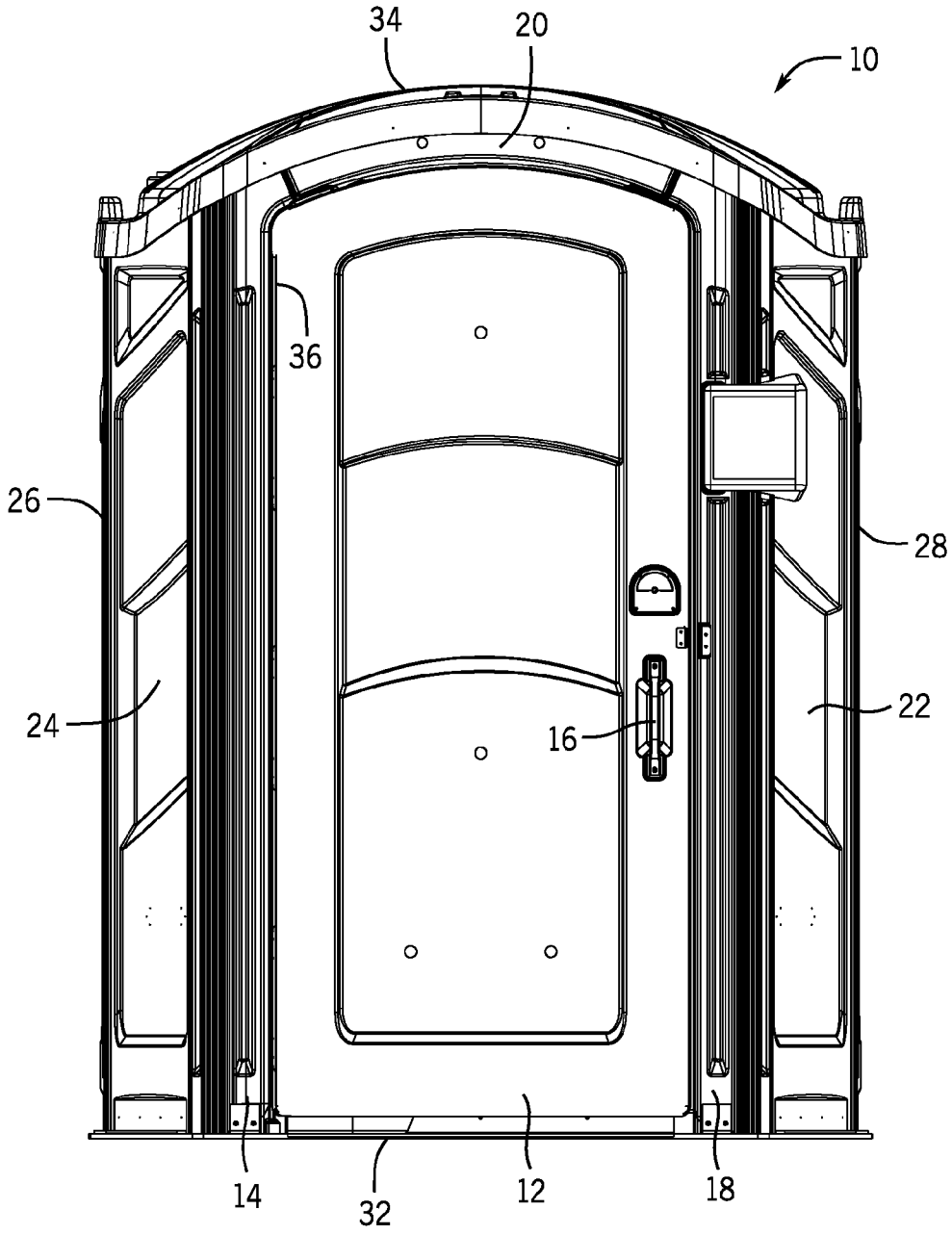
FIG. 2 is a front plan view of the example portable toilet illustrated in FIG. 1.
Figure 3:
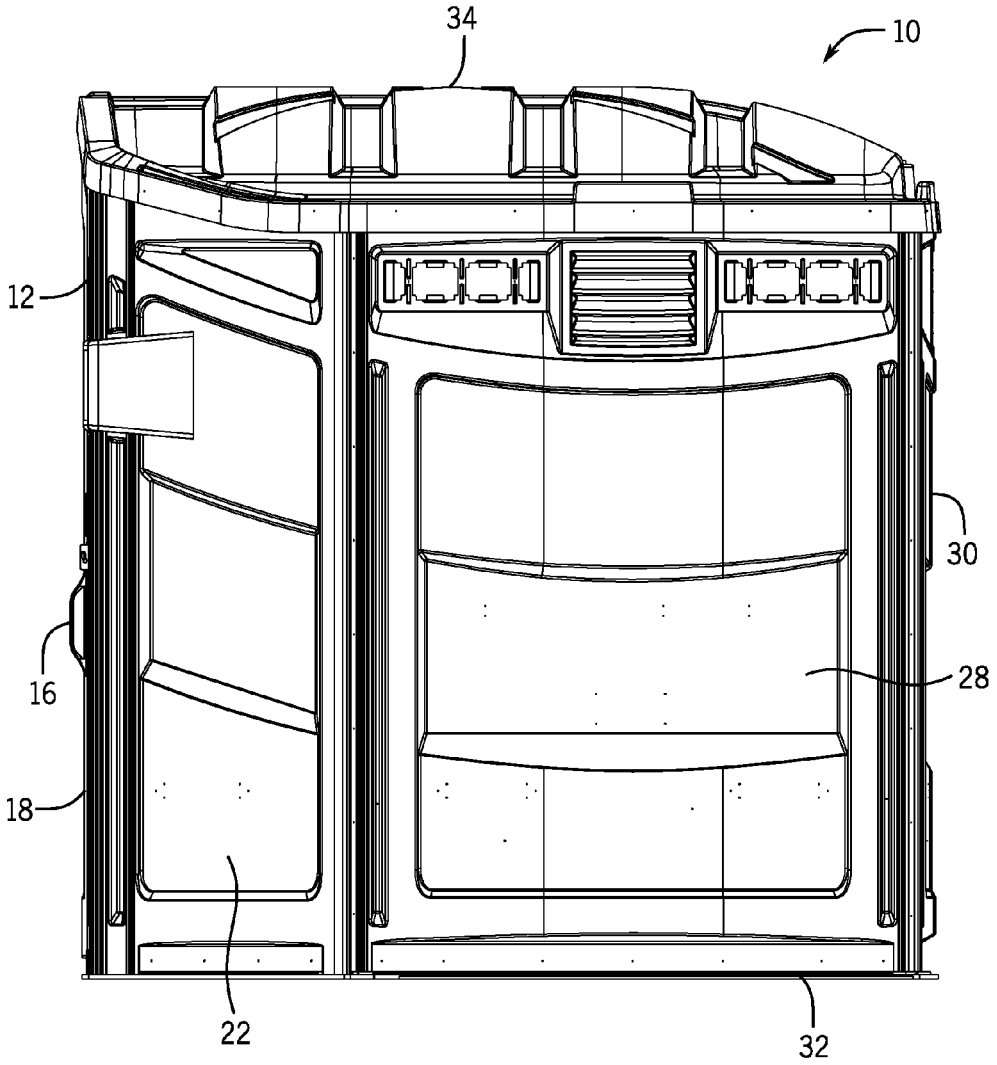
FIG. 3 is a side plan view of the example portable toilet illustrated in FIG. 1.

FIGS. 1-3 show an example portable toilet 10 (i.e., an American with Disabilities Act compliant portable toilet) incorporating an example hidden interlocking hinge assembly. The portable toilet 10 includes a door 12 that is hinged along a left vertical edge to a left jamb 14. The door 12 includes a handle 16 that can be grasped by a user to pivot the door between a closed position and an opened position. A right jamb 18 is connected to the left jamb 14 by a header 20 that couples the upper ends of the left jamb 14 and the right jamb 18. The jambs 14, 18 are shown as being integrally formed with respective side panels 24, 22. The side panels 24, 22, jambs 14, 18, side walls 26, 28, and back wall 30 are supported on a floor 32 and capped by a roof 34. As best shown in FIG. 2, no visible hinge is present where the left edge of the door 12 meets the left jamb 14, which also blocks a line of sight into the interior of the portable toilet. The door 12 includes a flange feature 36 extending along a left vertical edge that conceals the balance of the hinge.

Figure 4:
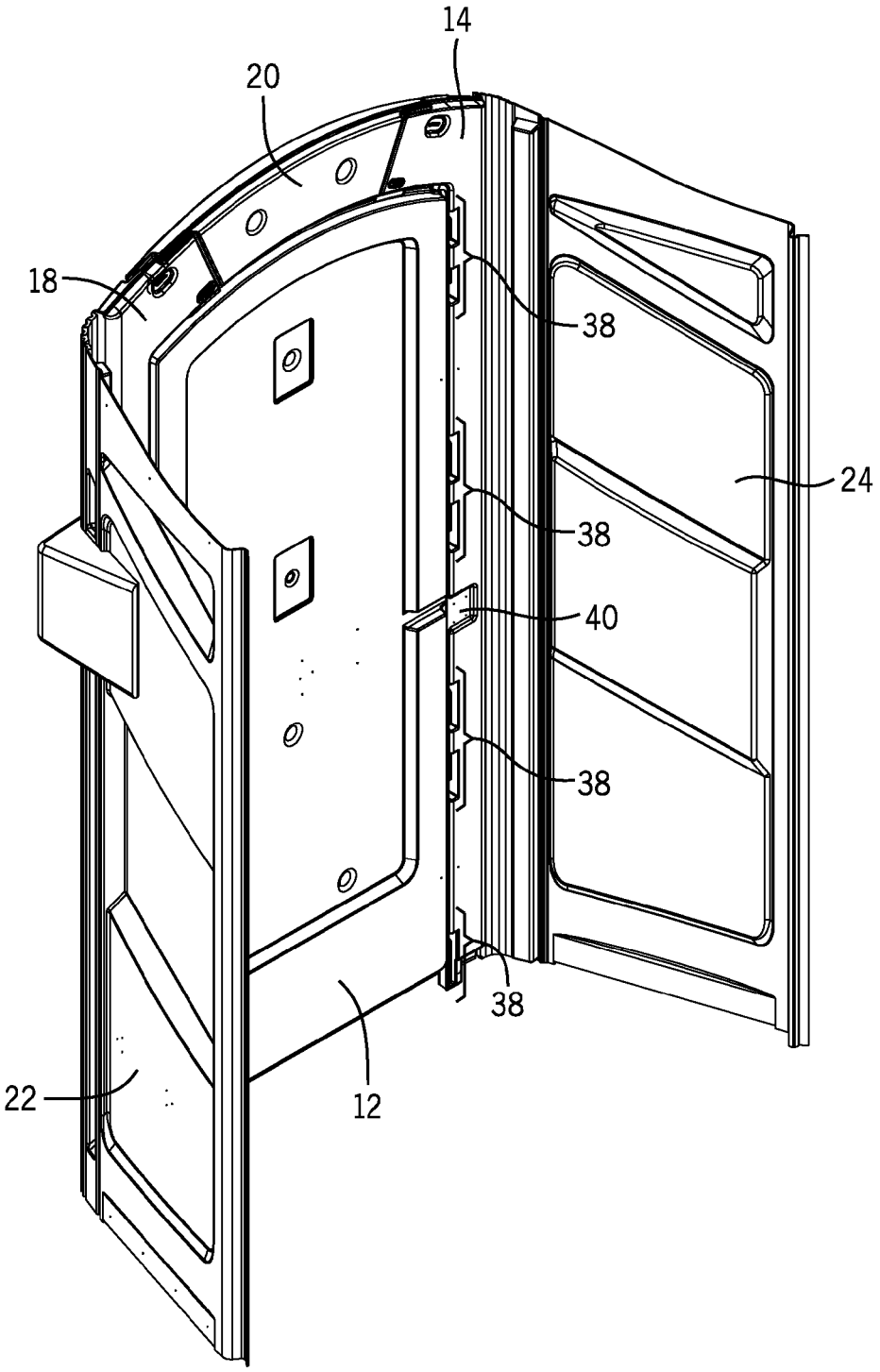
FIG. 4 is a rear isometric view of a portion of the example portable toilet illustrated in FIG. 1 showing example side panels, example jambs, an example header, and an example door in a closed position.
Figure 5:
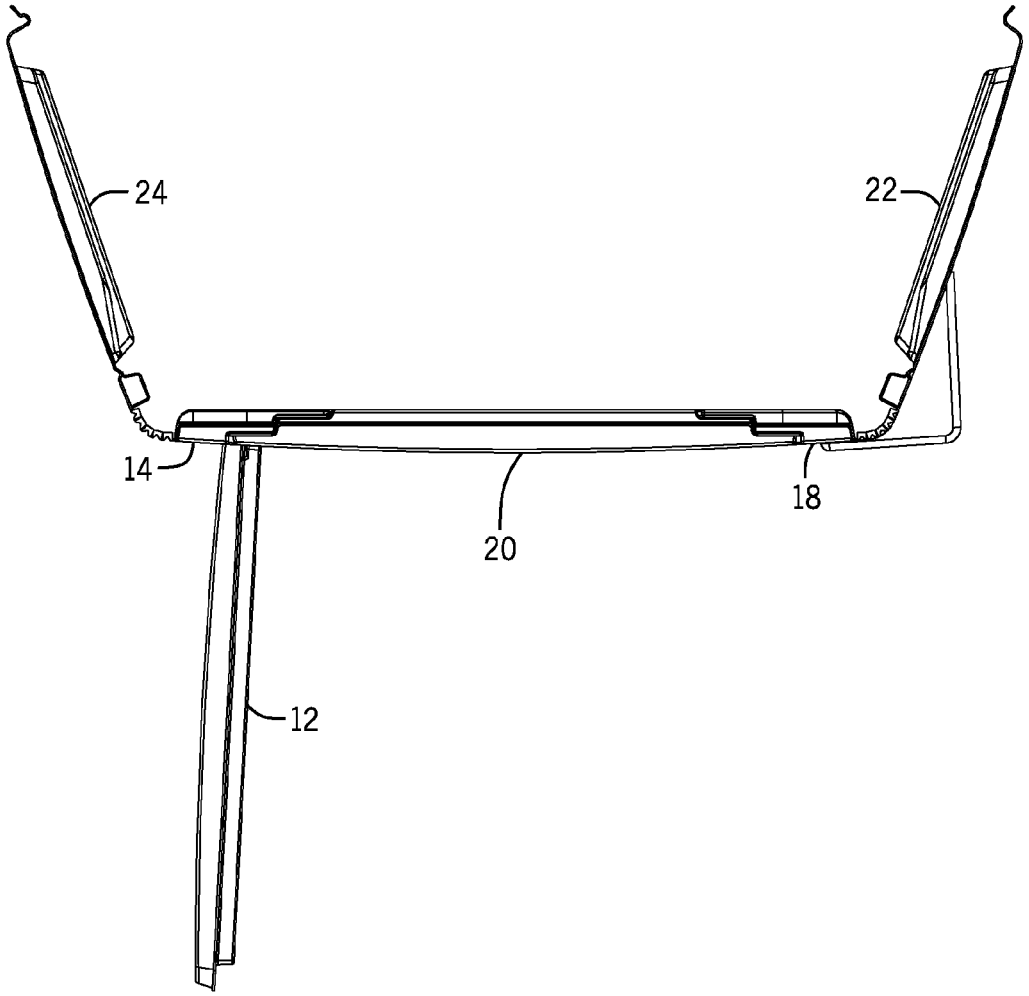
FIG. 5 is a top plan view of FIG. 4 showing the example door in an opened position.

FIG. 4 is a rear view of the door 12, jambs 14, 18, header 20, and side panels 22, 24, with the balance of the example portable toilet removed. Jamb knuckles 38 are formed in the left jamb 14 and are shown from the interior where the edge of the door 12 (i.e., the right side as viewed from the back of the door 12 in FIG. 4) meets the left jamb 14 (i.e., the hinged jamb). Several sets of jamb knuckles 38 are illustrated in the example embodiment and are somewhat evenly spaced apart; one skilled in the art will appreciate that any number and relative positioning of jamb knuckles 38 may be used depending on the particular application requirements. A mounting pad 40 for a door closure mechanism (e.g., spring, strut, etc.) is shown as a square depression molded into the back side of the door 12; the opposite end of the door closure mechanism is attached to the back side of the door 12. While FIG. 4 shows the door 12 in a closed position, FIG. 5 is a top view showing the door 12 pivoted or swung into an opened position, whereat the flange 36 pivots into a depression 42 formed in the left jamb 14. In the example embodiment, the jambs 14, 18 and the header 20 generally define a plane and the door 12 also generally defines a plane. In the closed position, the plane of the jambs 14, 18/header 20 is substantially parallel to the door plane, and in the opened position, the plane of the door 12 is skewed relative to the plane of the jambs 14, 18/header 20. Some applications may include a contoured jamb/header and/or door that do not establish a planar surface, in which case the opened position and the closed position are defined by the particular application.

Figure 6:
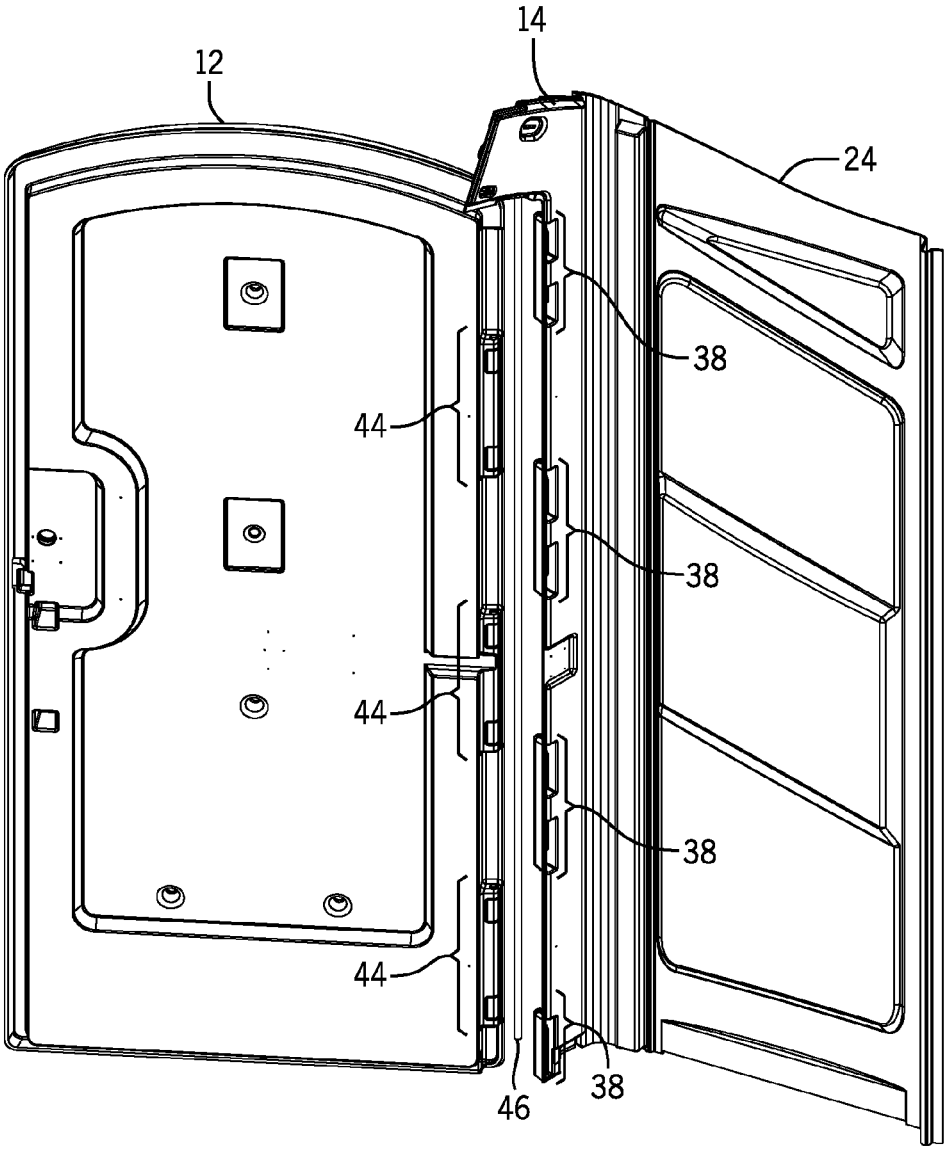
FIG. 6 is a rear isometric exploded view showing the example door, the example jamb, and an example hinge pin.
Figure 7:
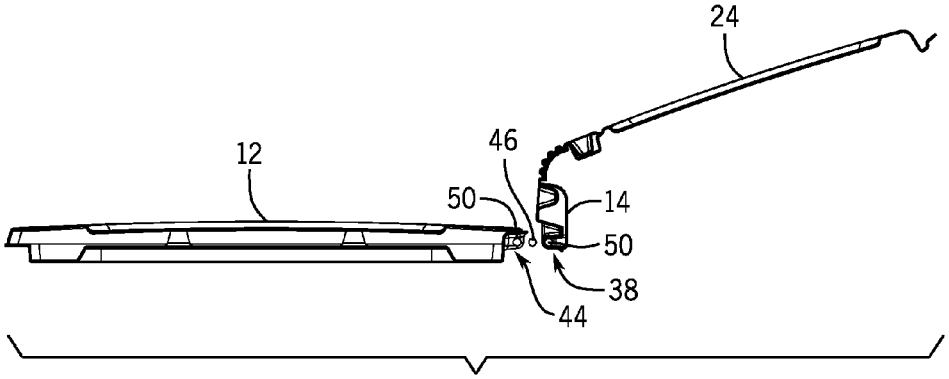
FIG. 7 is a top plan view of FIG. 6.
Figure 8:
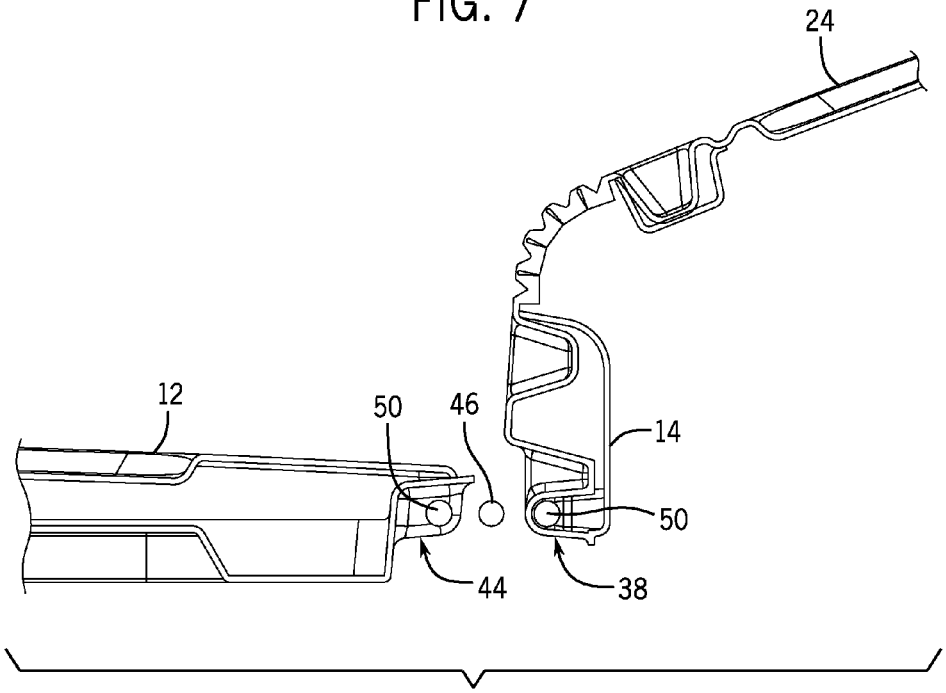
FIG. 8 is a detail top plan view of a portion of FIG. 7.

FIG. 6 is a rear exploded view showing the door 12 separated from the left jamb 14, exposing a series of door knuckles 44 spaced along the edge of the door 12. The door knuckles 44 interlock with the jamb knuckles 38 and are coupled to the jamb knuckles 38 by a hinge pin 46 that extends though the knuckles 38, 44. As a result, the door 12 can pivot about a hinge axis 48 that is defined by the door knuckles 44, the jamb knuckles 38, and the hinge pin 46. FIGS. 7 and 8 illustrate top views of the door 12, the hinge pin 46, and the left jamb 14. A cylindrical opening 50 is shown in both the door knuckles 44 and the jamb knuckles 38 that is configured to receive the hinge pin 46 to pivotally couple the door 12 and the left jamb 14.

Figure 9:
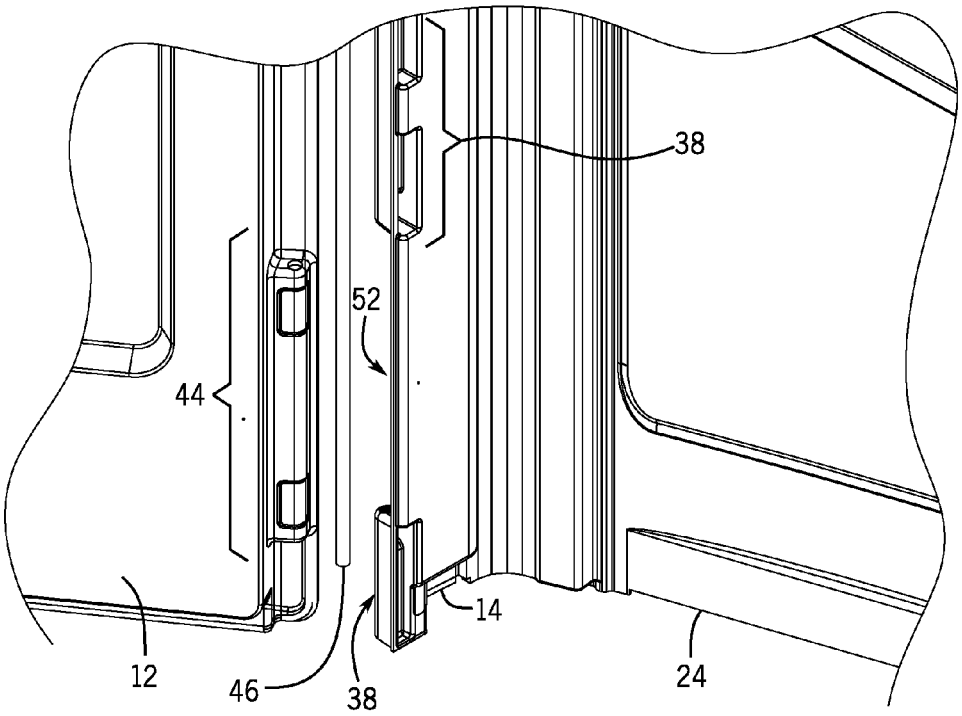
FIG. 9 is a detail isometric view of a portion of FIG. 6 showing an example door knuckle and an example jamb knuckle.
Figure 10:
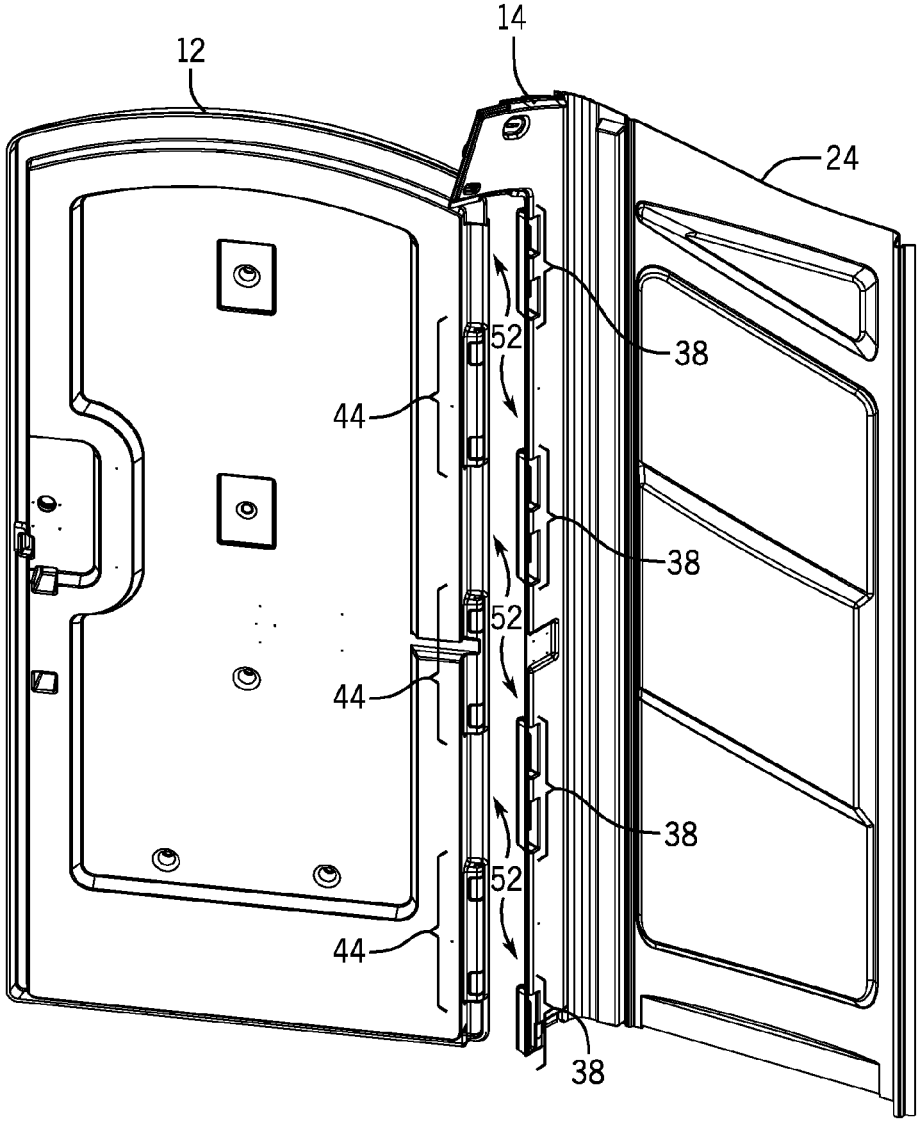
FIG. 10 is a rear isometric exploded view similar to FIG. 6 with the example hinge pin removed.
Figure 11:
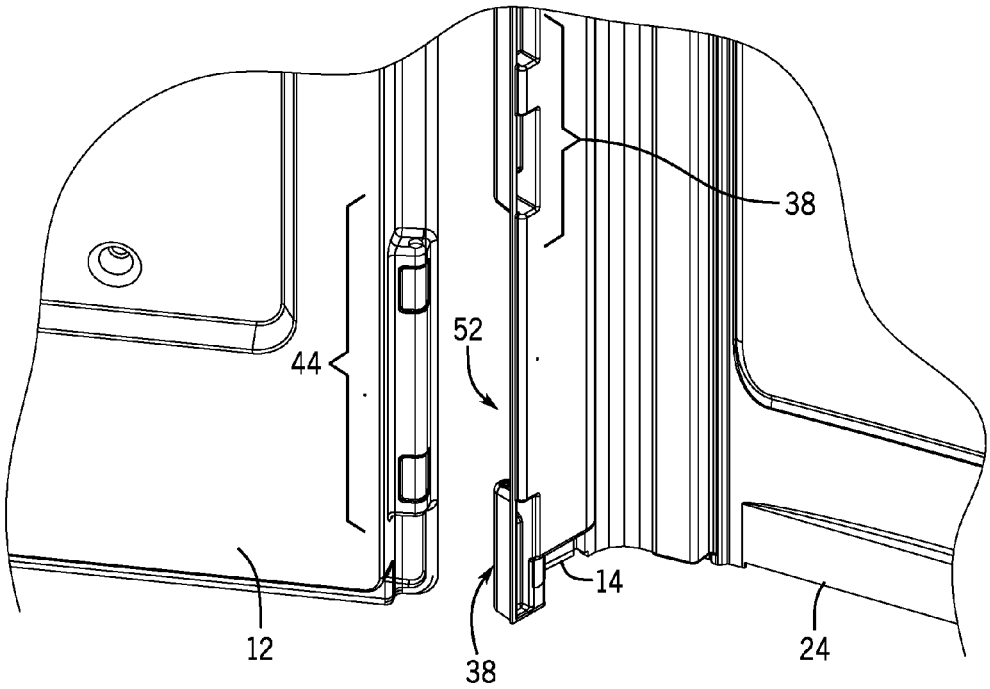
FIG. 11 is a detail isometric view of a portion of FIG. 10 showing the example door knuckle and the example jamb knuckle with the example hinge pin removed.

FIG. 9 shows a door knuckle 44 spaced apart from a pair of mating jamb knuckles 38. When assembled, the door knuckle 44 is seated into a space 52 between the jamb knuckles 38 and secured by the hinge pin 46. FIG. 10 is similar to FIG. 6 with the example hinge pin 46 removed, and FIG. 11 is similar to FIG. 9, also with the hinge pin 46 removed. The various spaces 52 formed in the door 12 and the left jamb 14 to accommodate the jamb knuckles 38 and door knuckles 44, respective, are also shown in FIG. 10.

FIGS. 12-17 show a series of horizontal cross sections through the door 12 and the left jamb 14 when the door 12 is in the closed position. These figures illustrate the example construction of the door 12 and the left jamb 14 that achieves the example hidden interlocking hinge assembly. In the example embodiment, both the door 12 and the left jamb 14

(and the right jamb 18, albeit without jamb knuckles 38) are formed from two sheets (e.g., plastic sheets) that are bonded (e.g., fused, molded together, etc.) at specific locations and spaced apart at other locations.

Figure 12:
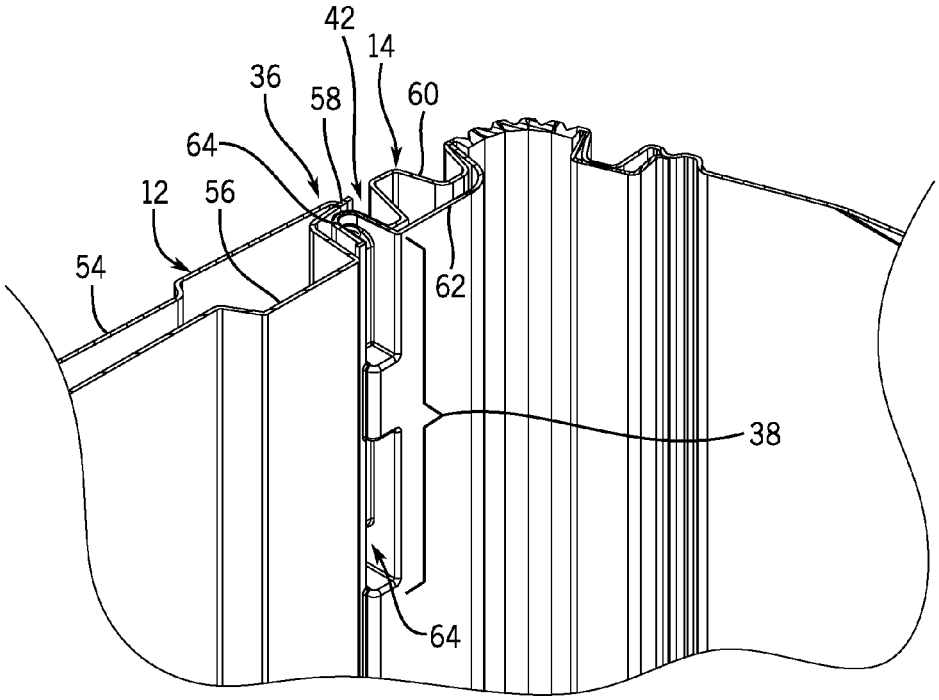
FIG. 12 is an isometric, horizontal cross section through the example door and the example jamb showing the example door in the closed position.

FIG. 12 shows the door 12 having an outer sheet 54 and an inner sheet 56 that are bonded along a seam 58. While the inner sheet 56 extends beyond the outer sheet 54, in the example embodiment both the outer sheet 54 and the inner sheet 56 form the flange 36 that conceals, covers, hides, or obscures the balance of the hinge assembly. The left jamb 14 is also formed from an outer sheet 60 and an inner sheet 62 that are selectively bonded (e.g., compressed during the molding process). The inner sheet 62 and the outer sheet 60 of the left jamb 14 are bonded to form a portion 64 of the jamb knuckle 38. For example, the example jamb knuckle 38 includes bonded inner and outer sheets 62, 60 approximately along one inch from the top and one inch from the bottom. The left jamb 14 defines a depression, a recess, or a "gap" 42 (as viewed from the outside of the portable toilet) that is sized to accommodate at least a portion of the flange 36 on the door 12 when the door 12 is pivoted into the opened position.

Figure 13:
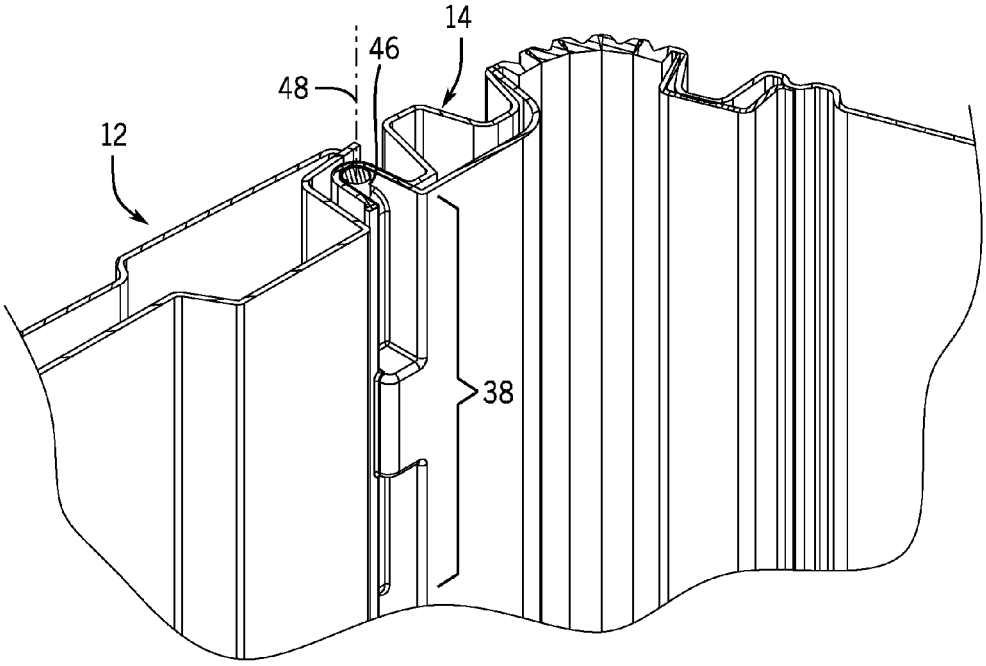
FIG. 13 is an isometric, horizontal cross section similar to FIG. 12 at a lower elevation showing the example hinge pin.
Figure 14:
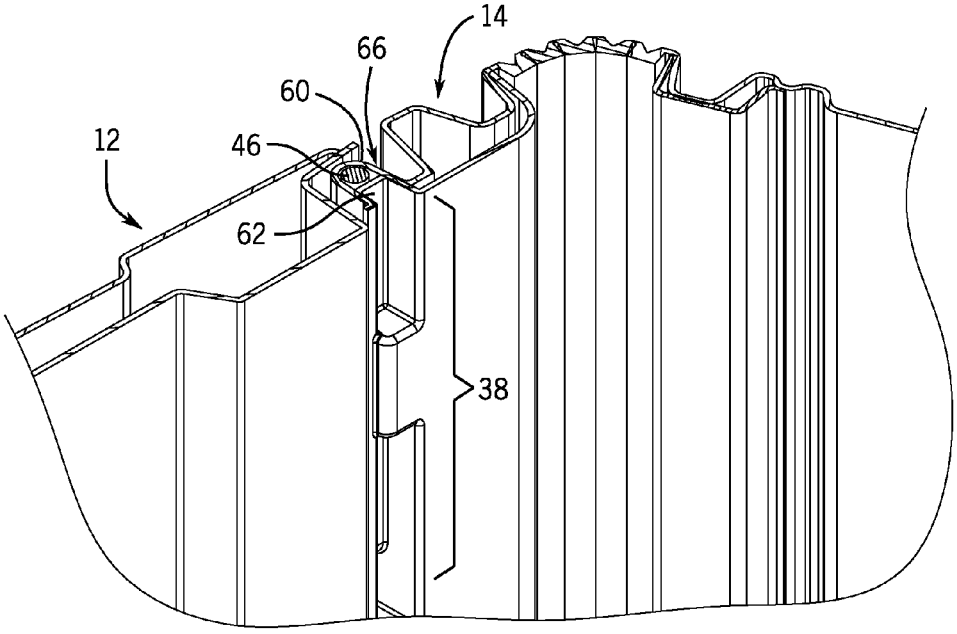
FIG. 14 is an isometric, horizontal cross section similar to FIG. 13 at a lower elevation.
Figure 15:
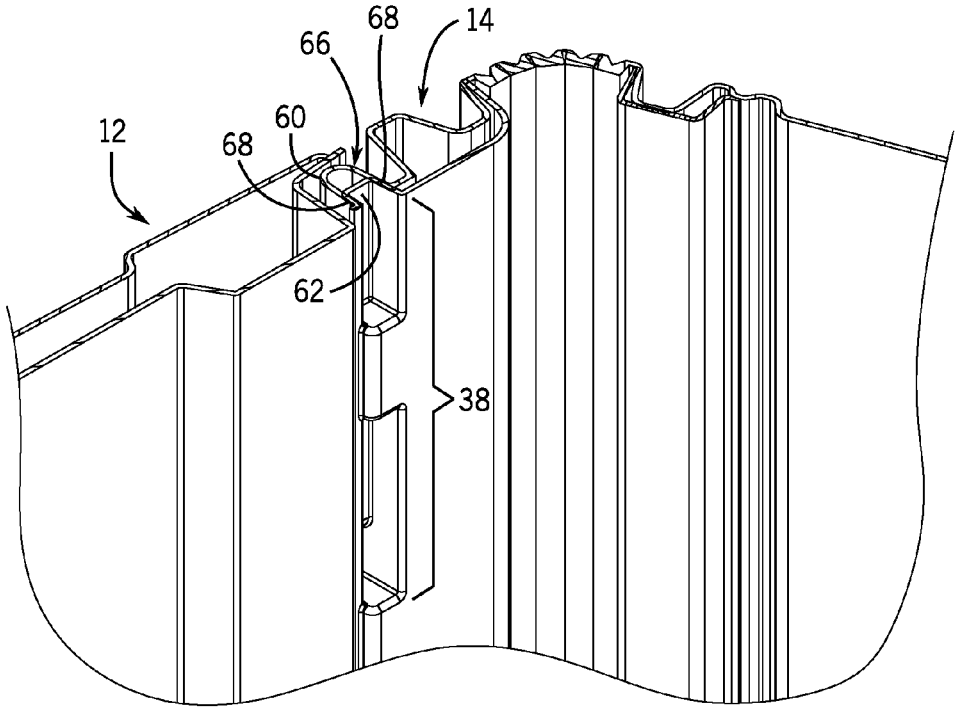
FIG. 15 is an isometric, horizontal cross section similar to FIG. 14 with the example hinge pin removed.
Figure 16:
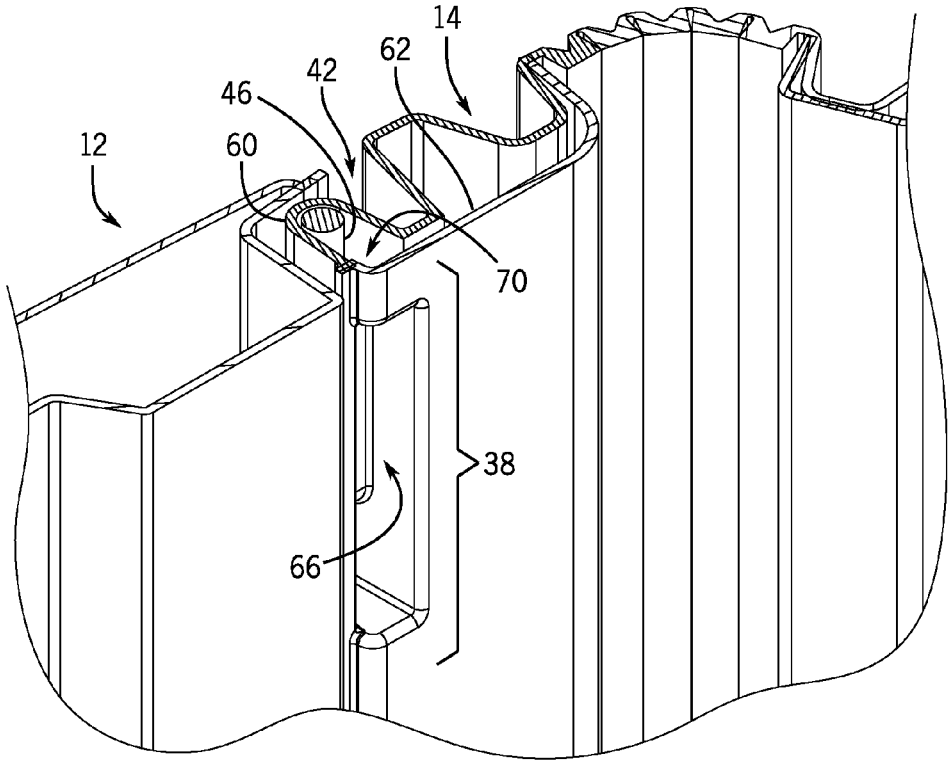
FIG. 16 is an isometric, horizontal cross section similar to FIG. 14 at a lower elevation.
Figure 17:
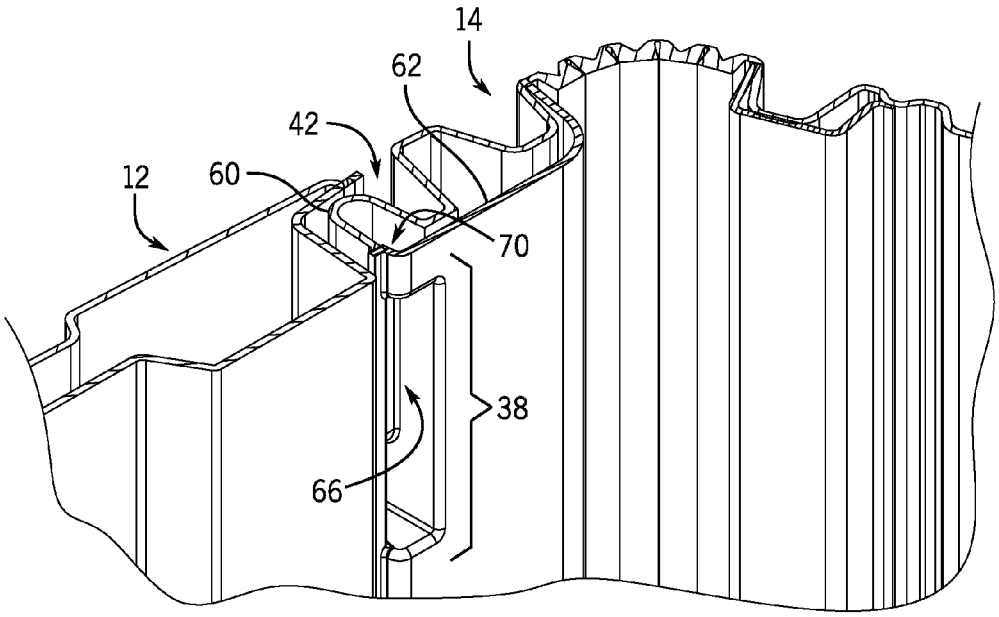
FIG. 17 is an isometric, horizontal cross section similar to FIG. 16 with the example hinge pin removed.

FIG. 13 is a cross section similar to FIG. 12 at a lower elevation showing the example hinge pin 46 extending along the hinge axis 48 through the jamb knuckle 38. FIG. 14 is a cross section similar to FIG. 13 at a lower elevation showing a barrel 66 formed between the inner sheet 62 of the left jamb 14 and the outer sheet 60 of the left jamb 14. The barrel 66 is formed where the sheets 60, 62 are not bonded (i.e., beyond one inch from the top of the jamb knuckle 38 of the example embodiment); the opening 50 is formed (e.g., drilled or molded) in the barrel 66 to receive the hinge pin 46. The barrel 66 receives and positions the hinge pin 46 within the jamb knuckle 38 between the outer sheet 60 and the inner sheet 62 of the left jamb 14. FIG. 15 is similar to FIG. 14, but the hinge pin 46 has been removed to better show the barrel 66 formed in the jamb knuckle 38. The barrel 66 is partially formed by bonding the inner sheet 62 and the outer sheet 60 along opposing seams 68. FIG. 16 is another cross section similar to FIG. 14 at a lower elevation through a pocket 70 formed between two barrels 66 of the jamb knuckle 38. Between the barrels 66, the inner sheet 62 and the outer sheet 60 of the left jamb 14 are spaced apart, with the outer sheet 60 still forming a portion of the depression 42. FIG. 17 is similar to FIG. 16 with the hinge pin 46 removed to better show the pocket 70 between the barrels 66.

FIGS. 18-21 are horizontal cross sections through the example door 12 and the example left jamb 14 showing the example door 12 in the opened position. In the opened position, the flange 36 of the door 12 is pivoted about the hinge pin 46 and into the depression 42 formed in the left jamb 14, without binding on the left jamb 14.

Figure 18:
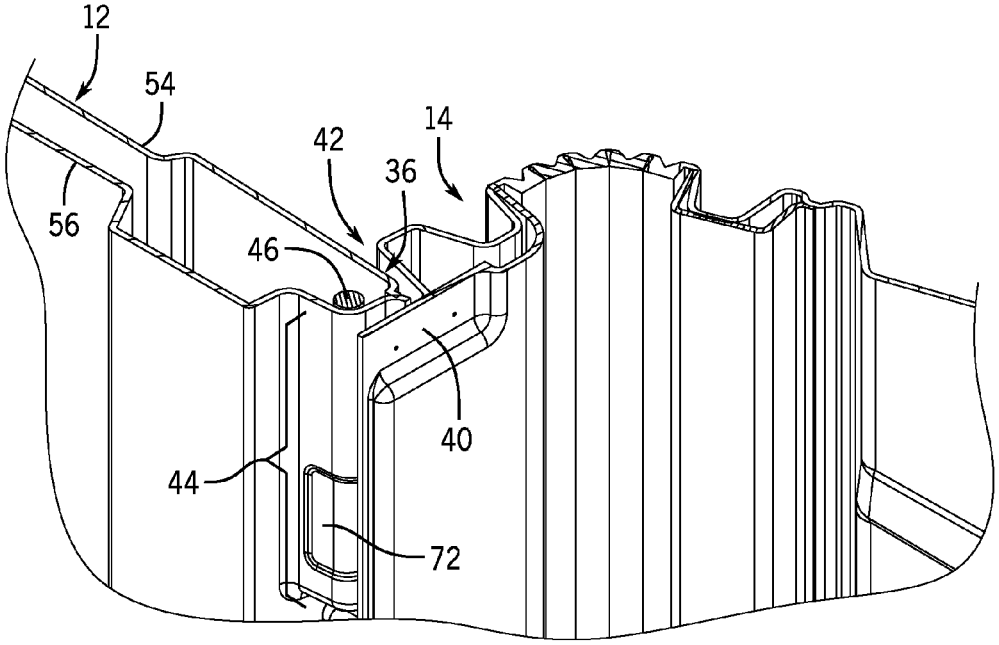
FIG. 18 is an isometric, horizontal cross section through the example door and the example jamb showing the example door in the opened position.

FIG. 18 is a cross section through the mounting pad 40 of the left jamb 14. A door knuckle 44 is also shown receiving the hinge pin 46. The door knuckle 44 is generally formed between bonded strips of the inner sheet 56 and the outer sheet 54 of the door 12. In addition, the inner sheet 56 includes a sunken pad 72 that is configured to more closely abut the hinge pin 46 thereby reducing slop or play between the door knuckle 44 and the hinge pin 46.

Figure 19:
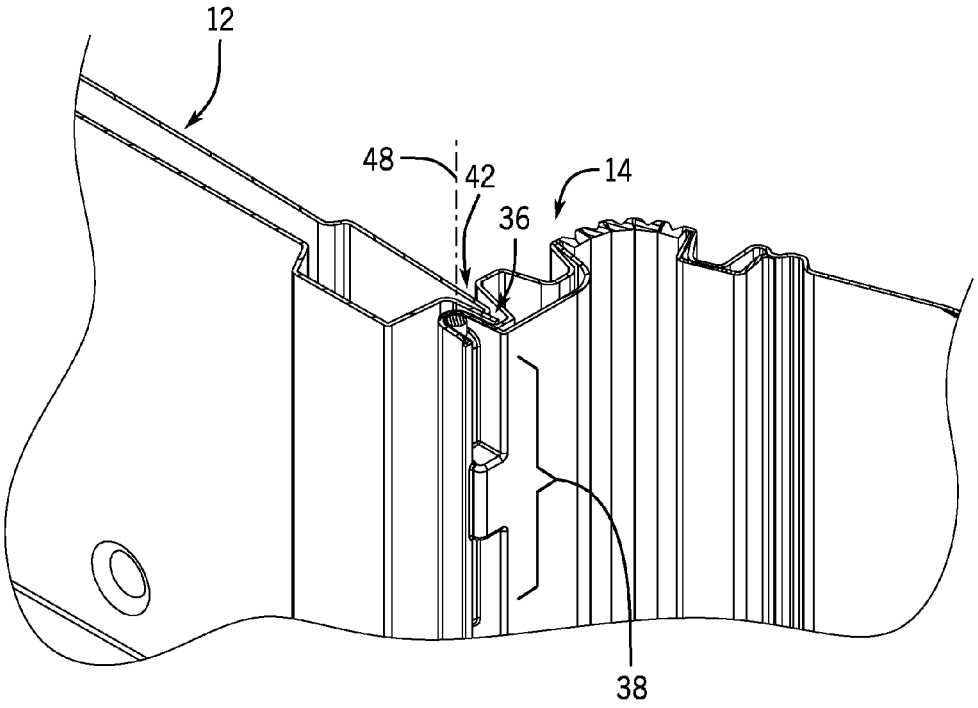
FIG. 19 is an isometric, horizontal cross section similar to FIG. 13 showing the example door in the opened position.
Figure 20:
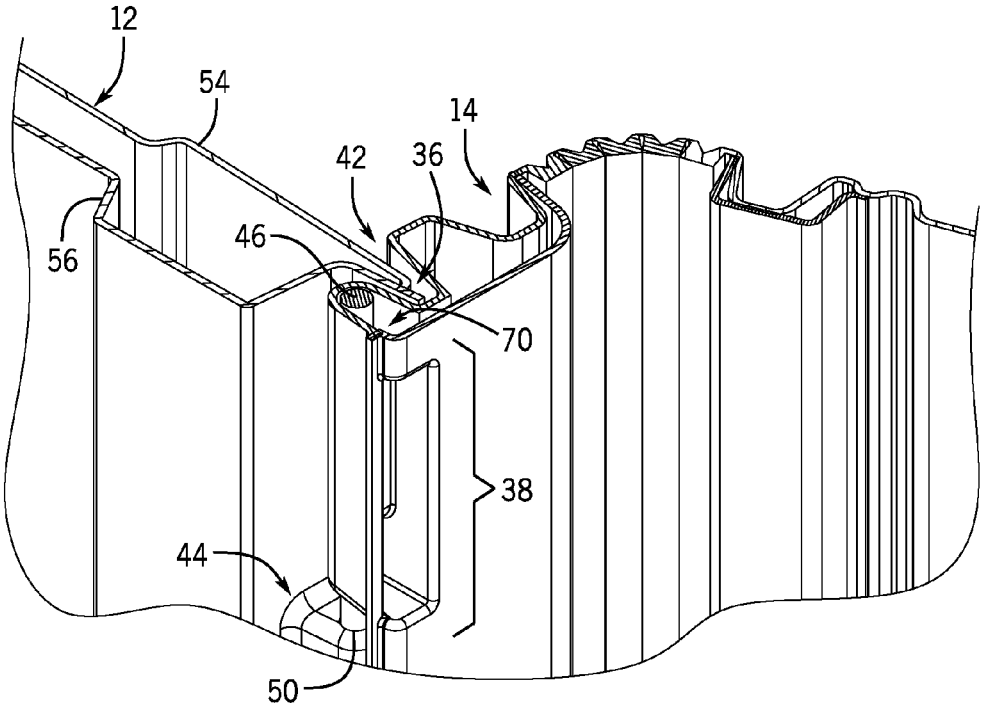
FIG. 20 is an isometric, horizontal cross section similar to FIG. 16 showing the example door in the opened position.
Figure 21:
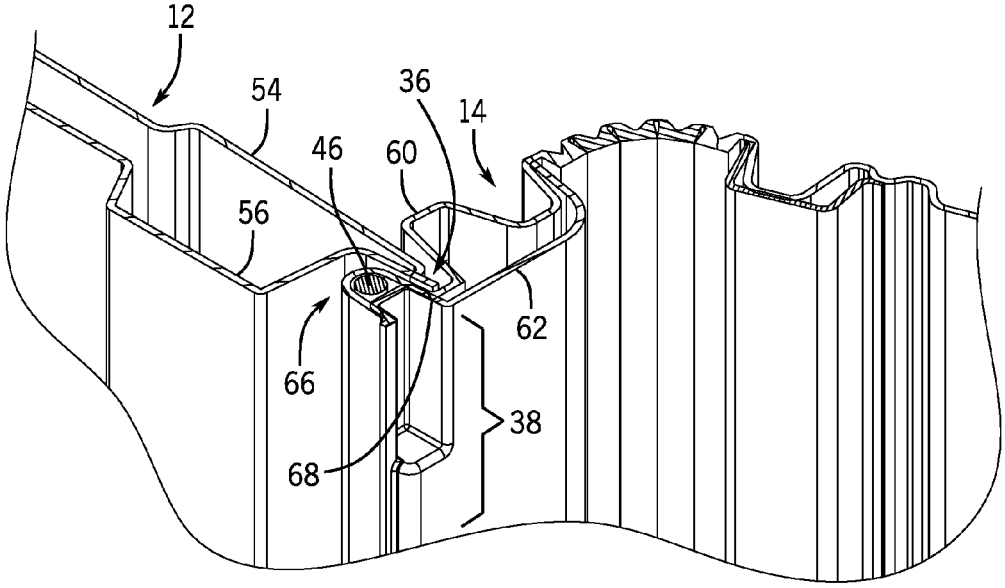
FIG. 21 is an isometric, horizontal cross section similar to FIG. 14 showing the example door in the opened position.

FIG. 19 is a cross section similar to FIG. 13 showing the example door 12 in the opened position. Again, the flange 36 of the door 12 is shown pivoted about the hinge axis 48 into the depression 42, without binding on the left jamb 14. FIG. 20 is a cross section similar to FIG. 16 showing the example door 12 in the opened position. A door knuckle 44 is shown beneath and interlocked with the jamb knuckle 38 via the hinge pin 46. An opening 50 in the door knuckle 44 for receiving the hinge pin 46 is shown. FIG. 21 is a cross section similar to FIG. 14 showing the example door 12 in the opened position. The edge of the flange 36 on the door 12 is adjacent to one of the seams 68 of the barrel 66, which is formed by the jamb knuckle 38.

Figure 22:
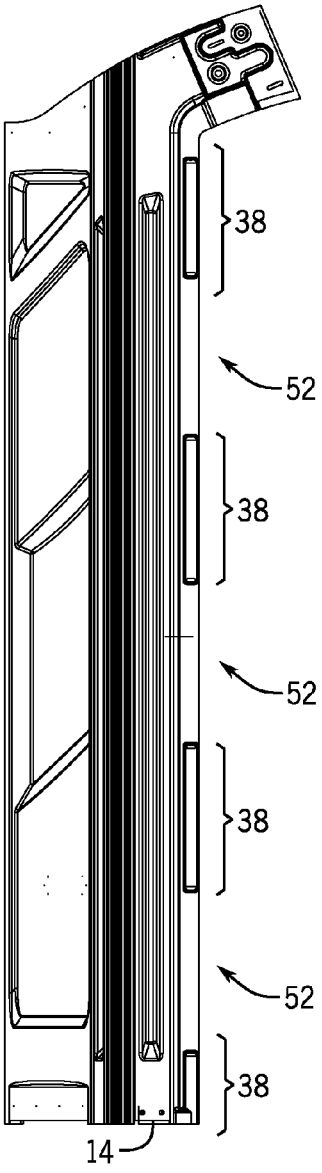
FIG. 22 is a front plan view of the example side panel and jamb.
Figure 23:
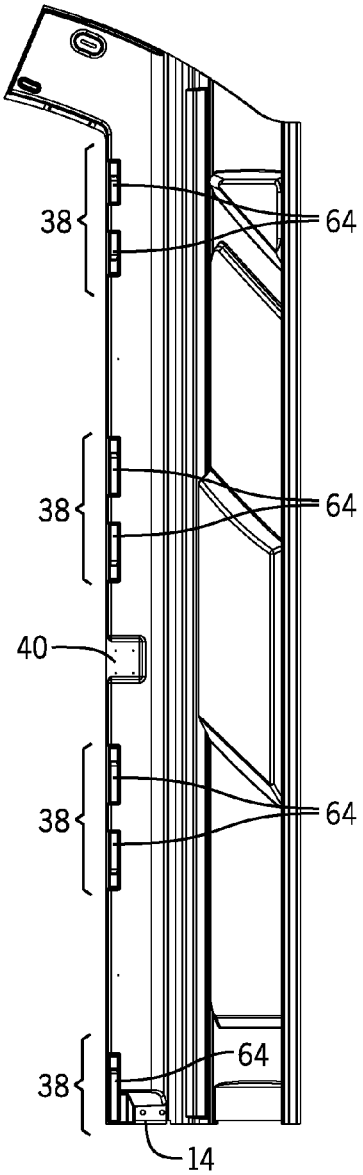
FIG. 23 is a rear plan view of the example side panel and jamb.
Figure 24:
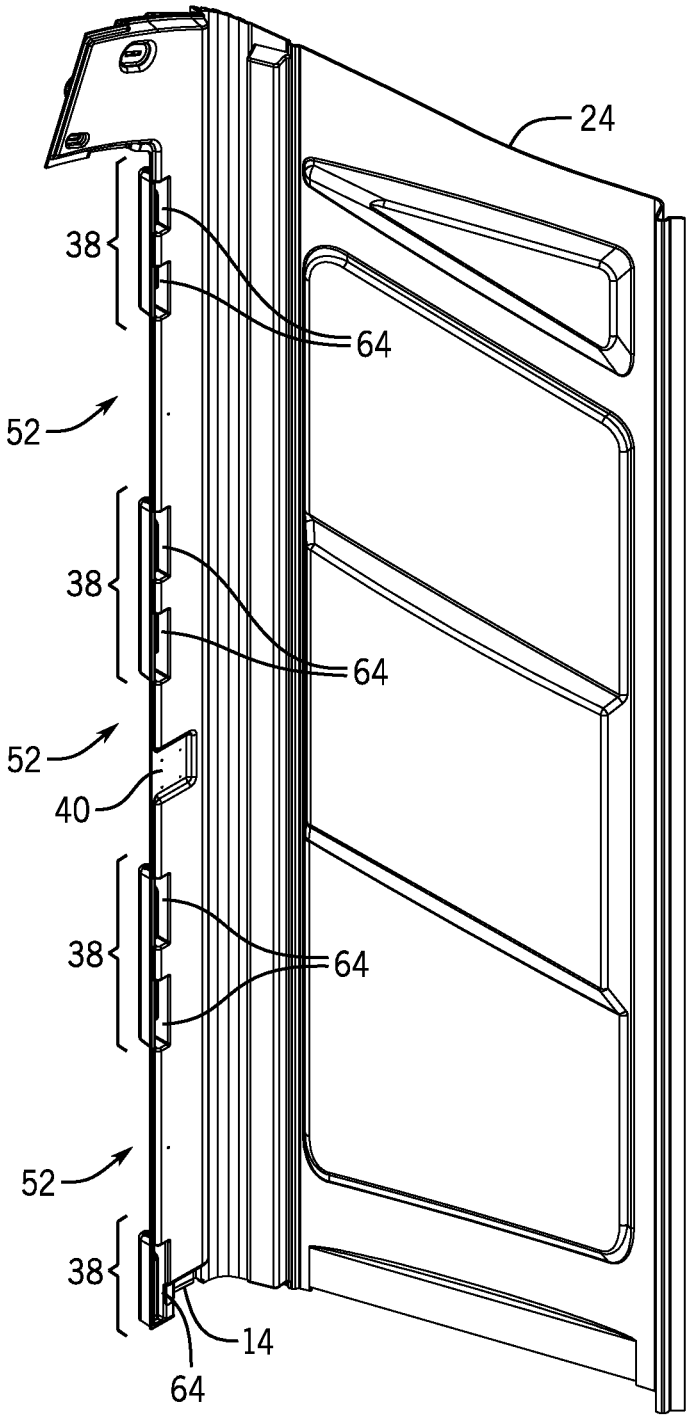
FIG. 24 is a rear isometric view of the example side panel and jamb.

FIG. 22 is a front (or outside) view of the left jamb 14, FIG. 23 is a rear (or inside) view of the left jamb 14, and FIG. 24 is a rear/inside isometric view of the left jamb 14. The jamb knuckles 38 are shown vertically spaced along the left jamb 14. Any number and relative spacing of the jamb knuckles 38 may be used depending on the particular application requirements. As discussed above, the two sheets 60, 62 making up the jamb knuckles 38 are selectively bonded (e.g., molded together) to form barrels 66 and spaces 52 between the jamb knuckles 38 to receive and interlock with the various door knuckles 44.

Figure 25:
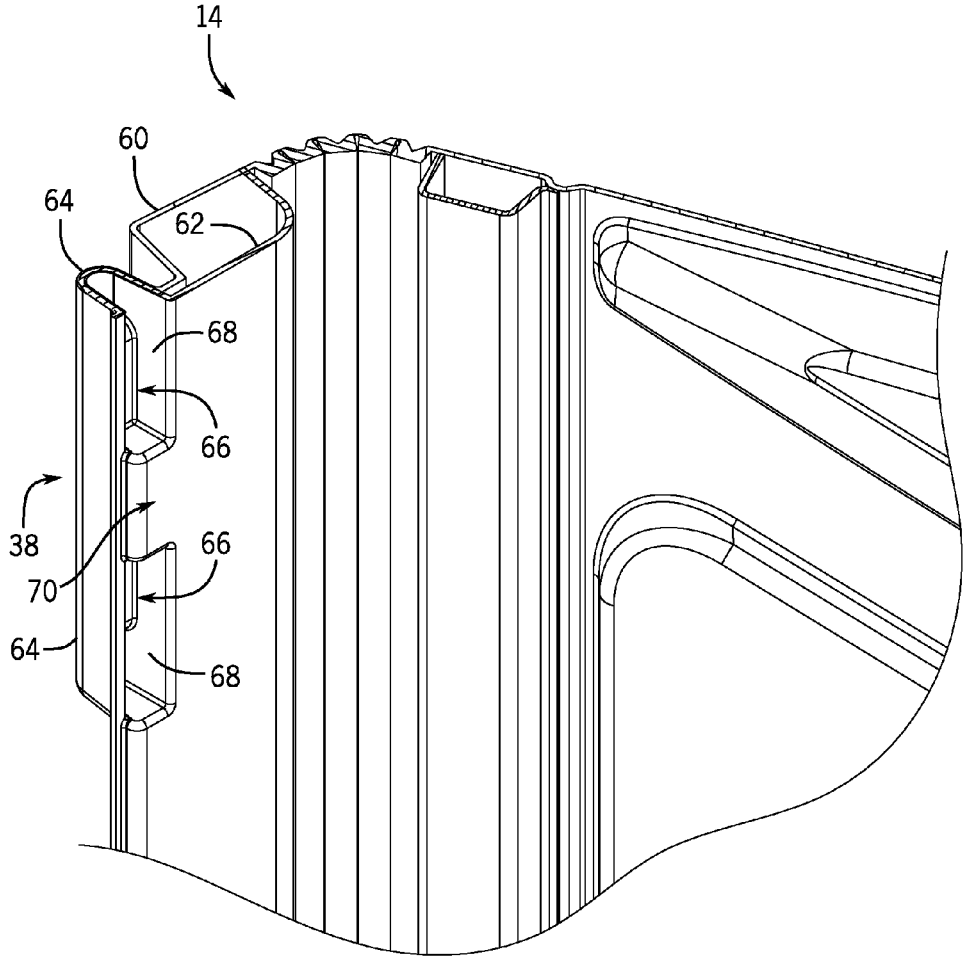
FIG. 25 is an isometric, horizontal cross section through the example jamb.

FIGS. 25-28 are horizontal cross sections through the example left jamb 14 at various elevations to further highlight the twin sheet molding of the left jamb 14. FIG. 25 shows the jamb knuckle 38 being selectively bonded (e.g., welded, seamed, etc.) from the top and bottom ends of the jamb knuckle 38 for approximately one inch or about 50% of the distance between an end of the jamb knuckle 38 and the start of the separated section that forms the pocket 70. The inner and outer sheets 62, 60 of the left jamb 14 are also bonded along the seams 68 between the ends of the jamb knuckle 38 and the start of the pocket 70.

Figure 26:
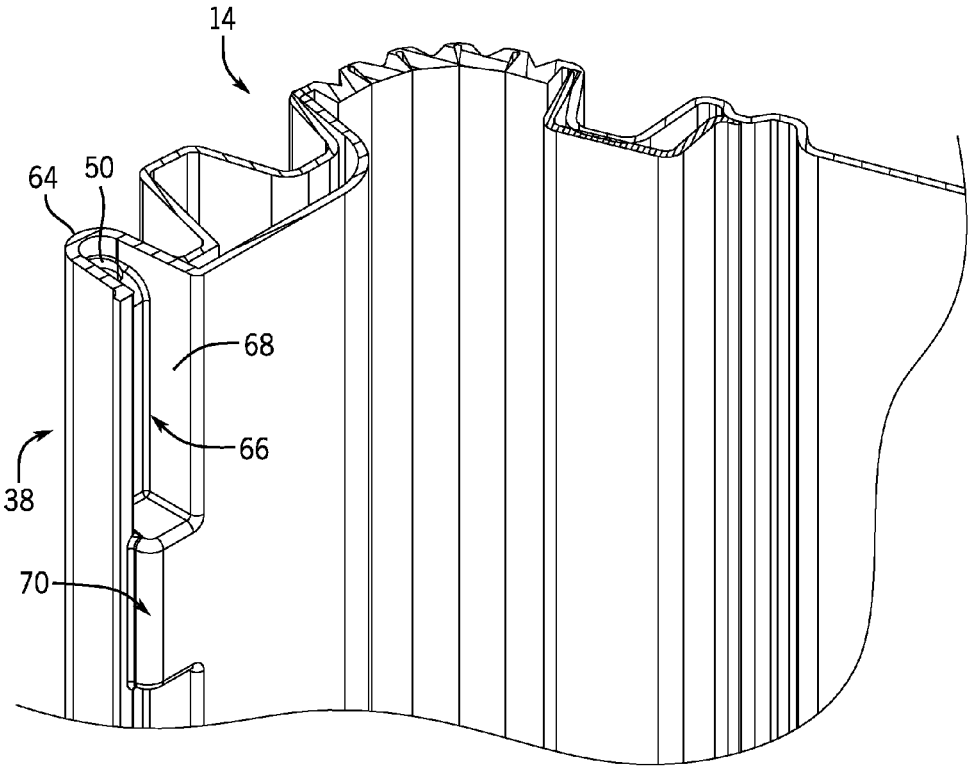
FIG. 26 is an isometric, horizontal cross section similar to FIG. 25 at a lower elevation.
Figure 27:
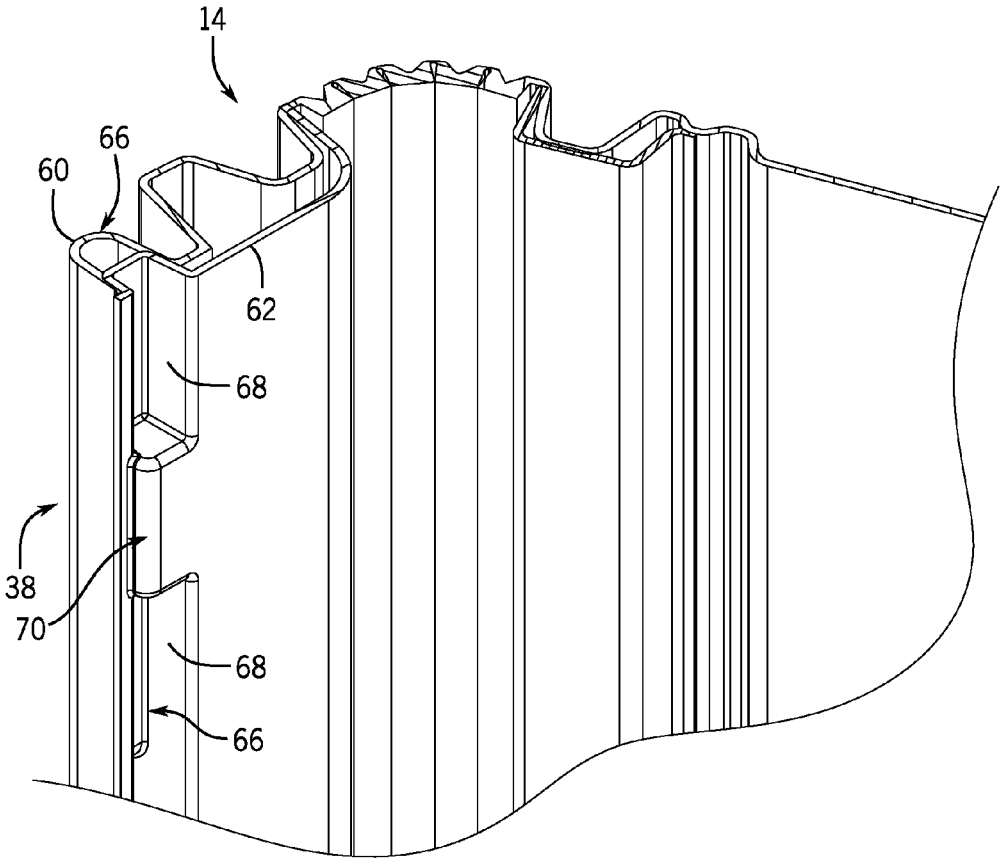
FIG. 27 is an isometric, horizontal cross section similar to FIG. 26 at a lower elevation.
Figure 28:
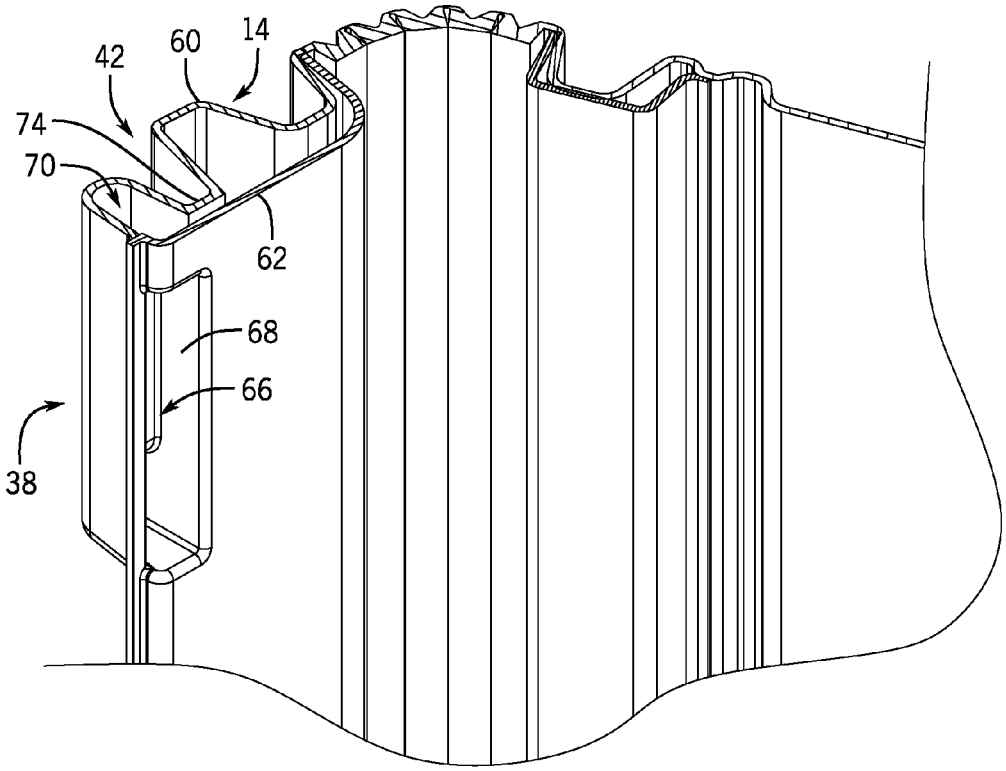
FIG. 28 is an isometric, horizontal cross section similar to FIG. 27 at a lower elevation.

FIG. 26 is a cross section similar to FIG. 25 at a lower elevation at which the opening 50 in the barrel 66 of the jamb knuckle 38 is visible. The hinge pin 46 is inserted into this opening 50 to ultimately pivotally interlock the door 12 and the left jamb 14. FIG. 27 is another cross section similar to FIG. 26 at a lower elevation showing the barrel 66 formed by the outer sheet 60 and the inner sheet 62 of the left jamb 14. FIG. 28 is a further horizontal cross section similar to FIG. 27 at a lower elevation showing the pocket 70 formed between the outer sheet 60 and the inner sheet 62 of the left jamb 14. The inner sheet 62 is separated (e.g., spaced apart) from the outer sheet 60 at the pocket 70 and at the valley 74 of the depression 42.

Figure 29:
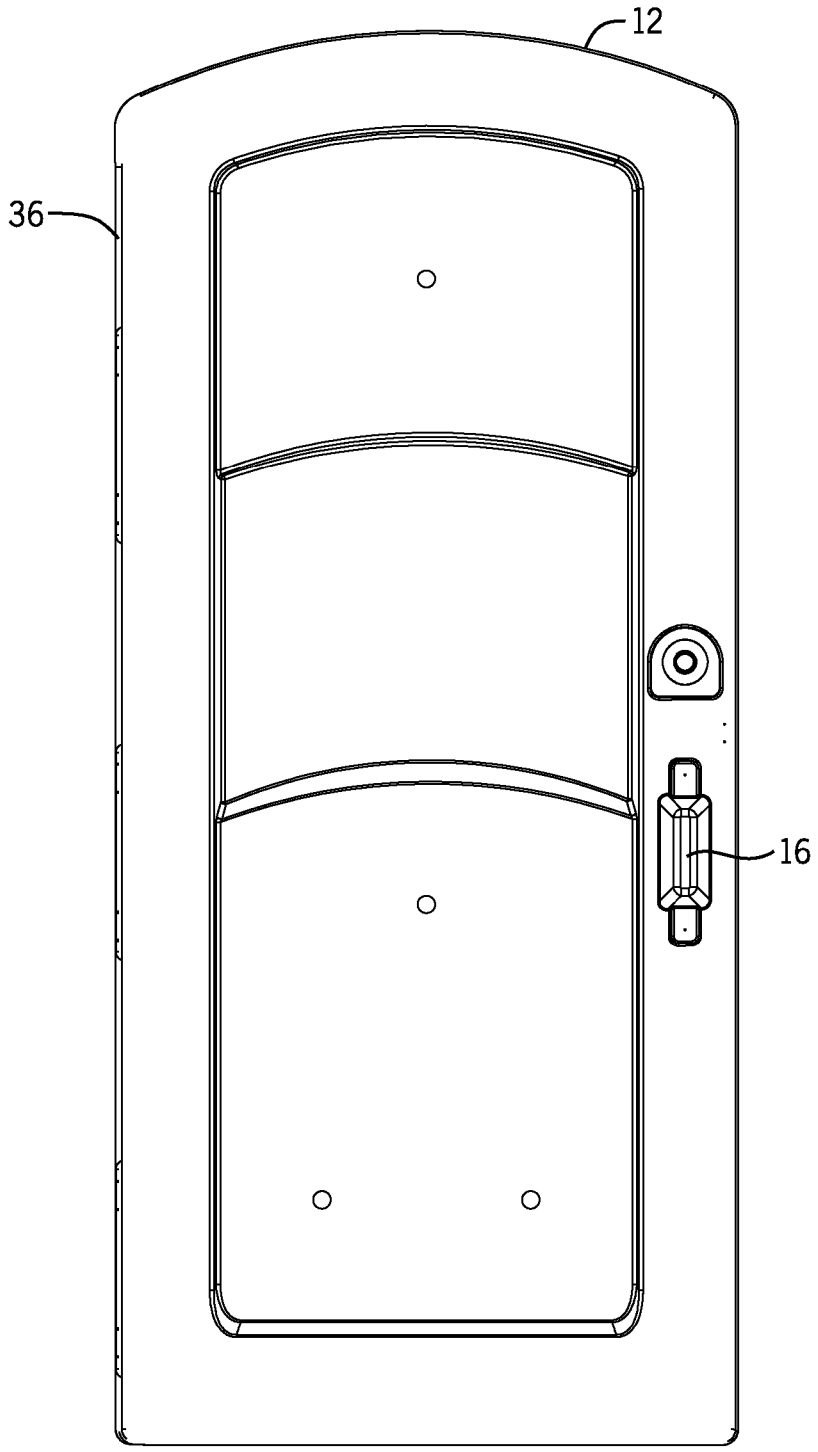
FIG. 29 is a front plan view of the example door.

FIGS. 29-32 illustrate the example door 12. FIG. 29 is a front (or exterior) view of the door 12. The left edge of the door 12 (as viewed in FIG. 29) has the flange 36 that conceals or hides the door knuckles 44 and, when hinged to the left jamb 14, also covers the jamb knuckles 38. The flange 36 establishes a continuous surface extending substantially the full edge height of the door 12 that conceals the jamb knuckles 38, the door knuckles 44, and the interface between the knuckles 38, 44. The flange 36 provides a relatively flush transition between the door 12 and the left jamb 14, while also maintaining privacy by covering any gaps or openings found in traditional hinges. The specific sizing and form of the flange feature can be tailored to meet particular application requirements.

Figure 30:
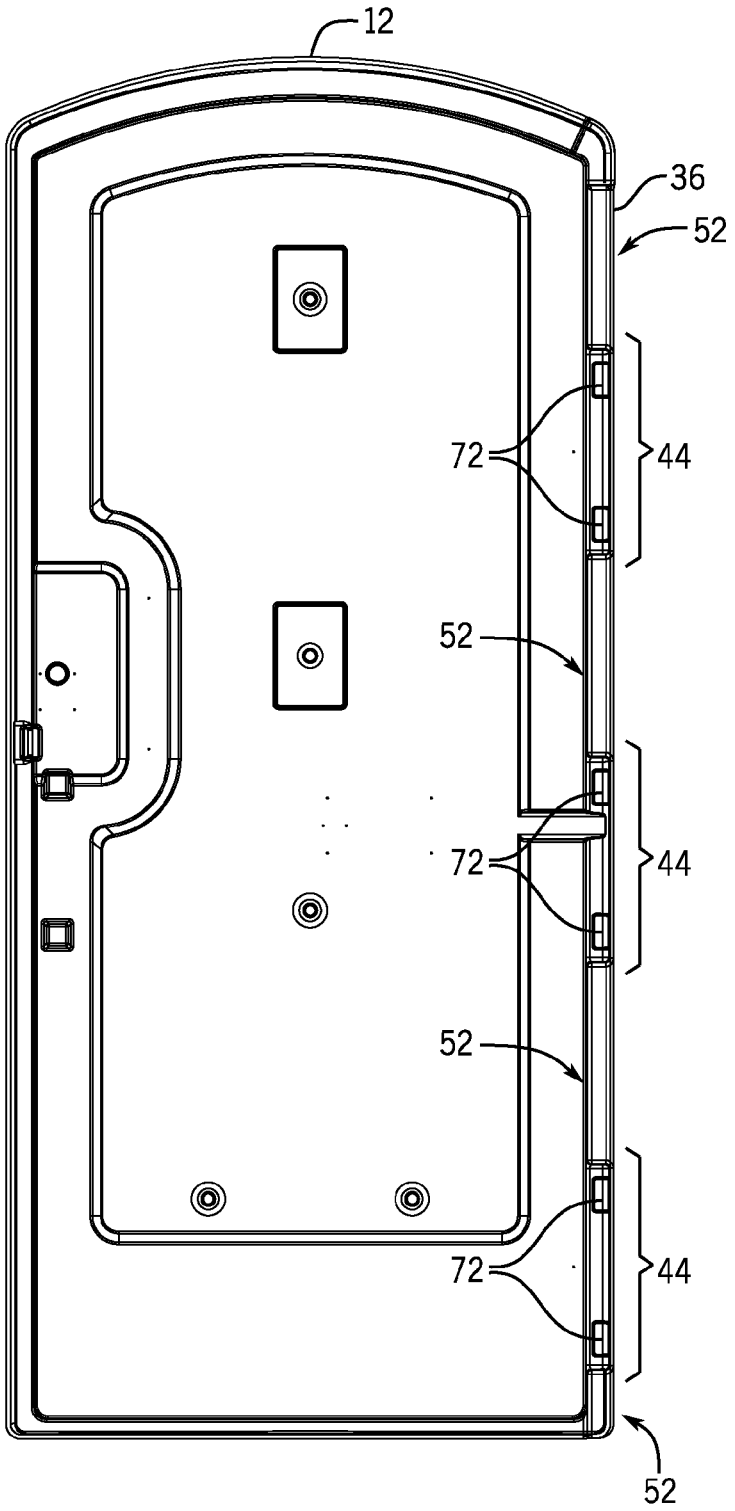
FIG. 30 is a rear plan view of the example door.
Figure 31:
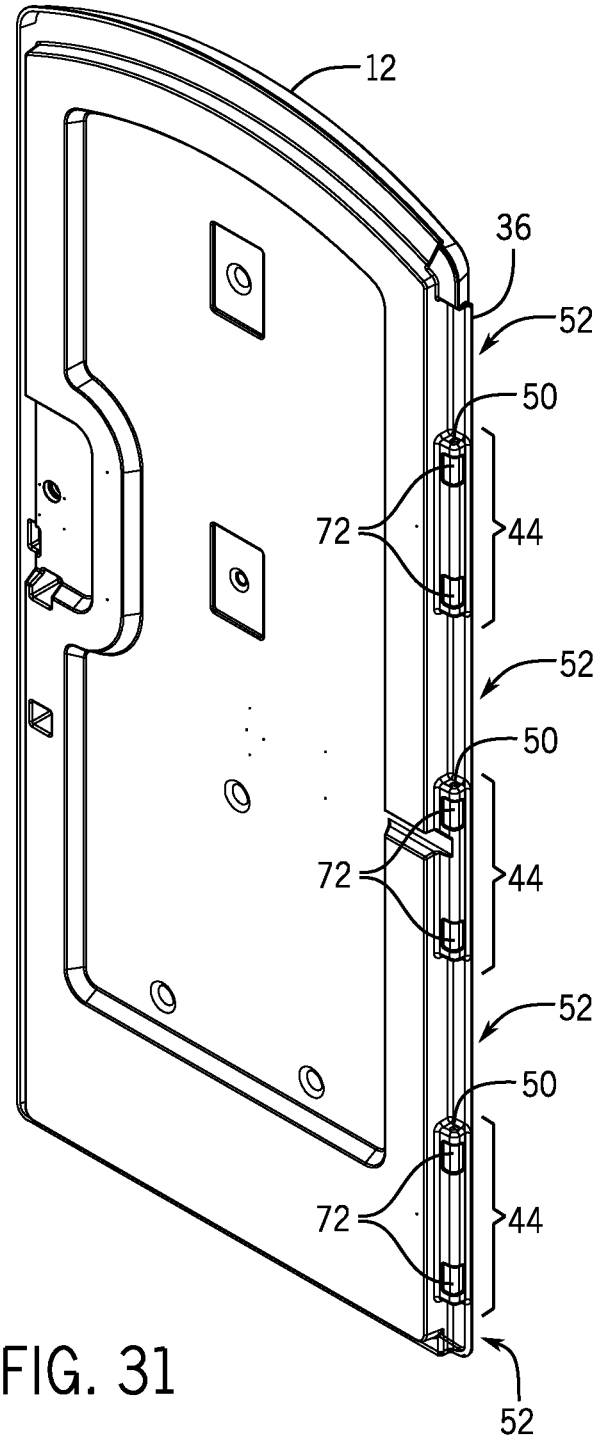
FIG. 31 is a rear isometric view of the example door.
Figure 32:
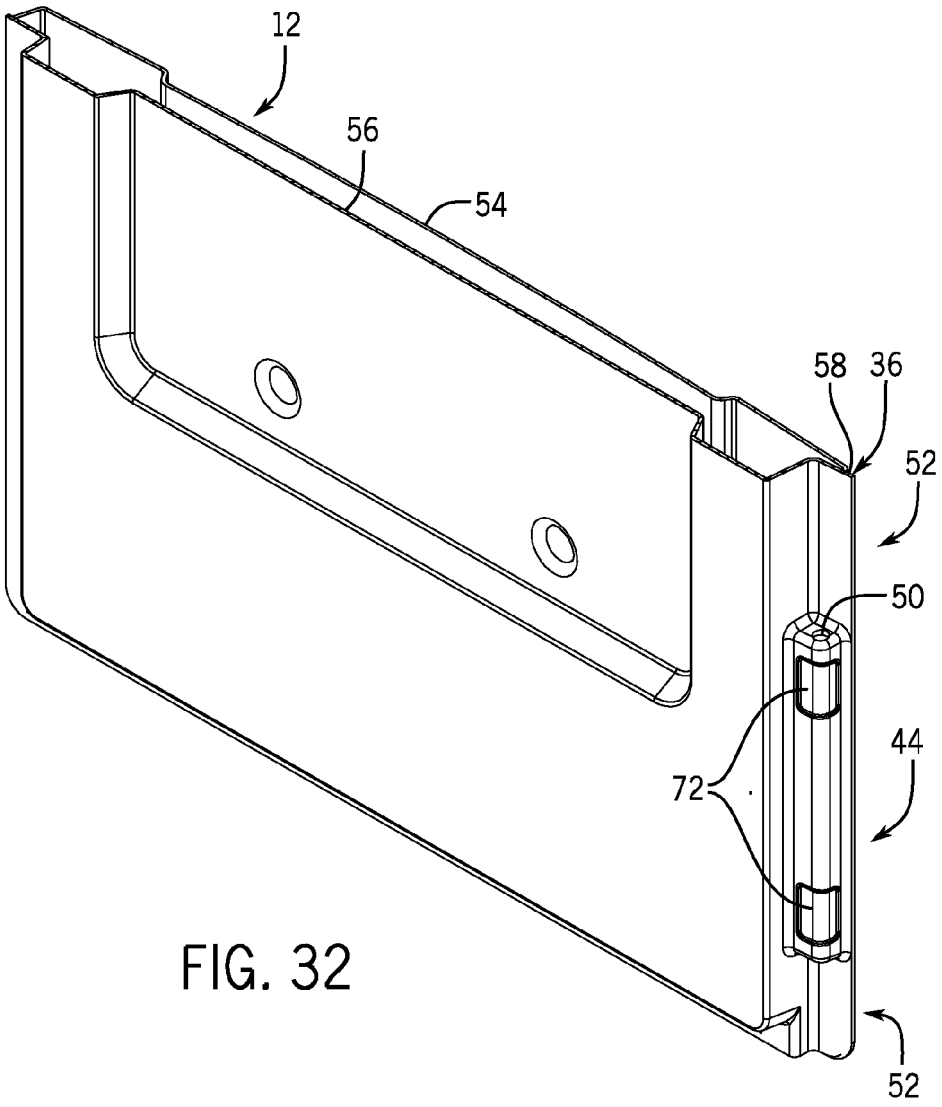
FIG. 32 is an isometric, horizontal cross section through the example door.

The door knuckles 44 are shown in FIGS. 30-32. FIG. 30 is a rear (or interior) view of the door 12 and FIG. 31 is a rear isometric view, both show the door knuckles 44 spaced along the edge of the door 12. The multiple recessed pads 72 are also shown along the door knuckles 44 and are configured to provide increased area to engage the hinge pin 46. A series of spaces 52 are also shown, and are configured to receive the jamb knuckles 38 when the door 12 is assembled to the left jamb 14. FIG. 31 also illustrates the openings 50 in the door knuckles 44 that receive the hinge pin 46 and the flange 36 that extends beyond the door knuckles 44 to conceal the door knuckles 44. FIG. 32 is an isometric cross section through the door 12 near the bottom of the door 12. The inner sheet 56 and the outer sheet 54 of the door 12 are shown as well as the flange 36 and the seam 58 bonding together the inner sheet 56 and the outer sheet 54.

The example door 12 and jambs 14, 18 may be formed of plastic in accordance with the process described in U.S. Pat. No. 7,807,080 titled Offset Mold Twinning, which is hereby incorporated by reference as if fully set forth herein, including thermoforming and blowmolding. In addition, the hidden interlocking hinge concept can be made from any other suitable material (e.g., metal, composites, etc.) or method (e.g., casting, machining, etc.).

Given the benefit of this disclosure, one skilled in the art will appreciate various modifications to the above concept that may be made. For instance, the relative proportions and dimensions of the components can be altered, and, where applicable, various components can be integrally formed or single components can be separated into multiple pieces. As one example, while the flange feature is illustrated as being associated with the door and the depression feature as being associated with the jamb, the flange may be coupled to the jamb and the depression may be defined by the door.

While there has been shown and described what is at present considered the preferred embodiments, it will be appreciated by those skilled in the art, given the benefit of this disclosure, that various changes and modifications can be made without departing from the scope of the invention defined by the following claims.

I claim:

1. A hidden interlocking hinge assembly comprising:

a jamb including an inner jamb plastic layer and an outer jamb plastic layer selectively fused to form a jamb knuckle integrally formed with the jamb, the jamb knuckle forms a seam whereat the inner jamb plastic layer and the outer jamb plastic layer are fused and a barrel whereat the inner jamb plastic layer and the outer jamb plastic layer are spaced apart;

a jamb hinge pin opening formed through at least one of the seam and the inner jamb plastic layer of the barrel;

a door including an inner door plastic layer and an outer door plastic layer selectively fused to form a door knuckle integrally formed with the door;

a door hinge pin opening formed only through the inner door plastic layer;

a depression integrally formed with one of the jamb and the door; and a flange integrally formed with and extending from the other of the jamb and the door;

wherein the door knuckle and the jamb knuckle are configured to interlock along a hinge axis that is coaxial with the jamb hinge pin opening and the door hinge pin opening;

wherein the flange extends beyond the hinge axis; and wherein pivoting the door about the hinge axis pivots the flange into the depression.

2. The hidden interlocking hinge assembly of claim 1 wherein:

the depression is formed with the jamb; and the flange extends from the door.

3. The hidden interlocking hinge assembly of claim 2 wherein the flange extends beyond the jamb knuckle.

4. The hidden interlocking hinge assembly of claim 1 further comprising a hinge pin extending through the jamb knuckle and the door knuckle along the hinge axis.

5. The hidden interlocking hinge assembly of claim 4 wherein the flange extends beyond the hinge pin.

6. The hidden interlocking hinge assembly of claim 1 wherein the flange is integrally formed from the inner door plastic layer.

7. A hidden interlocking hinge assembly comprising:

a door formed from an inner door plastic layer and an outer door plastic layer selectively fused;

a plurality of door knuckles formed from at least one of the inner door plastic layer and the outer door plastic layer;

a plurality of door hinge pin openings formed only through the inner door plastic layer;

a flange formed from at least one of the inner door plastic layer and the outer door plastic layer;

a jamb formed from an inner jamb plastic layer and an outer jamb plastic layer selectively fused;

a plurality of jamb knuckles formed from the jamb inner plastic layer and the jamb outer plastic layer defining fused seams and spaced apart barrels;

a plurality of jamb hinge pin openings formed through the inner jamb plastic layer and the outer jamb plastic layer at the fused seams and the spaced apart barrels;

a recess formed from the outer jamb plastic layer; and a hinge pin extending through the plurality of door hinge pin openings and the plurality of jamb hinge pin openings to link the door knuckles and the hinge knuckles such that the door is pivotable between a closed position and an opened position;

wherein the recess is sized to receive at least a portion of the flange when the door is pivoted from the closed position to the opened position.

8. The hidden interlocking hinge assembly of claim 7 wherein the plurality of door knuckles are formed from the inner door plastic layer.

9. The hidden interlocking hinge assembly of claim 7 wherein the plurality of jamb knuckles are formed from both the jamb inner plastic layer and the jamb outer plastic layer.

10. The hidden interlocking hinge assembly of claim 7 wherein the recess is generally U-shaped and formed from the outer jamb plastic layer and at least one of the plurality of jamb knuckles.

11. The hidden interlocking hinge assembly of claim 1 wherein the jamb hinge pin opening is formed through both the seam and the inner jamb plastic layer of the barrel.

* * * * *